US006526921B1

(12) United States Patent
Roffelsen

(10) Patent No.: US 6,526,921 B1
(45) Date of Patent: Mar. 4, 2003

(54) METHOD FOR OPERATING A CLOSED HOT-WATER INSTALLATION AND APPARATUS TO BE USED THEREWITH

(75) Inventor: Franciscus Roffelsen, Helmond (NL)

(73) Assignee: Spiro Research B.V., Helmond (NL)

( * ) Notice: Subject to any disclaimer, the term of this patent is extended or adjusted under 35 U.S.C. 154(b) by 0 days.

(21) Appl. No.: 09/787,524

(22) PCT Filed: Sep. 29, 1999

(86) PCT No.: PCT/NL99/00604

§ 371 (c)(1),
(2), (4) Date: Jun. 18, 2001

(87) PCT Pub. No.: WO00/19149

PCT Pub. Date: Apr. 6, 2000

(30) Foreign Application Priority Data

Sep. 30, 1998 (NL) ..... 1010222

(51) Int. Cl.[7] ..... F22D 7/00

(52) U.S. Cl. ..... 122/406.1; 122/414; 137/202; 137/192; 237/66

(58) Field of Search ..... 122/406.1, 414, 122/415; 137/202, 178, 184, 187, 192, 429, 433, 448; 237/66

(56) References Cited

U.S. PATENT DOCUMENTS 3,796,227 A * 3/1974 Fujiwara ..... 137/202
4,103,700 A * 8/1978 Orrell et al. ..... 137/172
5,101,852 A * 4/1992 Magnasco ..... 137/174
6,119,951 A * 9/2000 Roffelsen ..... 137/202

* cited by examiner

*Primary Examiner*—Jiping Lu
(74) *Attorney, Agent, or Firm*—Varnum, Riddering, Schmidt & Howlett LLP

(57) ABSTRACT

Method and apparatus for operating a closed hot water installation provided with a pipe system, a boiler, heat exchangers, an expansion tank, a water make-up provision and a de-aerator, the method including the steps of opening a non-return valve to allow air to escape, detecting a water level in the de-aerator, feeding water to the closed installation when the level falls below a predetermined level, blocking opening of the non-return valve until the water level has fallen to a first level and starting the feed of water when a second lower level is reached.

11 Claims, 1 Drawing Sheet

METHOD FOR OPERATING A CLOSED HOT-WATER INSTALLATION AND APPARATUS TO BE USED THEREWITH

The invention relates to a method for operating a closed hot-water installation provided with a pipe system having a boiler and at least one heat exchanger and an expansion tank, a water make-up provision and a de-aerator, disposed at the highest point of the installation and comprising a non-return valve which is mounted in an air head and opens at a predetermined pressure to allow air to escape from the closed installation, the water level in the de-aerator being detected for feeding water to the closed installation via the water make-up provision when the level becomes too low. The invention also relates to an apparatus to be used with such method.

Such method and apparatus are known from Dutch patent specification 1000494, wherein the non-return valve determines the maximal working pressure, because de-aeration takes place at that maximal working pressure. If one wishes to be able to have that working pressure vary between reasonable limits, this can be regarded as a limiting factor for de-aeration.

The object of the invention is to provide more flexibility for the system, more in particular to provide a possibility for de-aerating below the maximal working pressure.

In accordance with the invention, in a method of the type mentioned in the preamble, this object is realized when the opening of the non-return valve is blocked until it is detected that the water level has fallen to a first level and the feed of water is started when a second, lower level is reached. Due to these features, the non-return valve can be set at any desired pressure, for instance the minimally required working pressure, which promotes the de-aerating possibilities. Indeed, through the level-dependent blocking of the non-return valve, the non-return valve is blocked against blowing off in the case of an insufficiently great air head. This implies that independently of the blow-off pressure of the non-return valve, such a great air head is in each case present that it is guaranteed that the water level cannot rise so high that dirt floating on that water can reach the non-return valve and the make-up valve, which could disturb the proper operation of those valves due to fouling. The blocking of the non-return valve also prevents the situation that in the event of a failure in the make-up valve, water can leak away via the non-return valve. In this manner, a failure-free, optimal de-aeration can advantageously be achieved at a working pressure varying within usual limits.

The blocking of the non-return valve can be realized relatively easily if, in accordance with a further embodiment of the invention, the detection of the first and the second water level is carried out by means of a float. This manner of operating can be optimized still further if the detection of the first and the second water level is carried out by means of one single float, whereby, when the first level is reached, a blocking of the de-aerator is removed and, when the second level is reached, the water make-up provision is opened.

The invention also relates to an apparatus which can be used with a method according to the invention as discussed hereinabove. To that end, an apparatus for discharging air from and feeding water to a closed hot-water installation is provided with a pipe system having a boiler and at least one heat exchanger, which apparatus, as known from Dutch patent specification 1000494, comprises a housing having a bottom side that can be brought into open communication with the pipe system and comprising, adjacent its top side, a vent valve and a water make-up valve which can be opened by a float displaceable in the housing. In accordance with the invention, the vent valve comprises a blocking member which in a blocking position shuts off the access to the vent valve and which can be moved into and out of said blocking position by a float displaceable in the housing. More in particular, it is preferred that the make-up valve and the blocking member be operated by one and the same float, while starting from the make-up valve in the open position and the blocking member in the position in which the access to the vent valve is released, the float, during a displacement in the direction of the make-up valve and the blocking member, shuts off the make-up valve first and, after a continued displacement, moves the blocking member into its blocking position. In this manner, the blocking of the non-return valve can be realized by extremely simple and minimal means.

In this manner, in accordance with the invention, a vent valve can be used in the form of a non-return valve which prevents connection with the environment during float-controlled opening of the de-aerating means and at a pressure in the housing lower than the ambient pressure. In other words: a non-return valve with a blow-off pressure which can be equal to the minimal working pressure. If so desired, that non-return valve may also be adjusted to any other pressure between the minimal and the maximal working pressure, because the blocking member closes off the access to the non-return valve if the air head has been reduced to a fixed value.

The blocking member and the non-return valve can be designed in many manners. A number of preferred embodiments are described in the claims and will be specified hereinafter.

With reference to exemplary embodiments schematically shown in the accompanying drawings, the method and apparatus according to the invention will be described and clarified exclusively by way of example. In these drawings.

Figure 1:
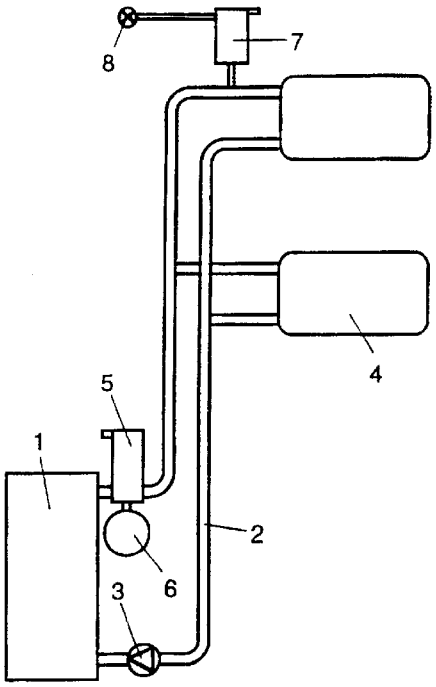
FIG. 1 shows a first embodiment of a closed heating installation.

FIG. 1 shows a closed heating installation comprising a boiler 1 and a pipe system 2 connected thereto. A pump 3 provides for the circulation of water heated by the boiler, via the pipes 2 to heat-exchanging elements 4 which, for instance, are intended for heating a room. Adjacent the outlet of the boiler 1, where the water is warmest and the air-dissolving capacity smallest, a de-aerator 5 is incorporated, which is in direct connection to the expansion tank 6. Arranged at the highest point of the installation is an apparatus 7 coupled, via a float-operated valve, to a water feed 8. The apparatus 7 further comprises a blow-off valve in the form of a non-return valve, while the access to the non-return valve is only released if a sufficiently great air head is present in the apparatus 7. The apparatus 7 will be explained in more detail hereinbelow, with reference to FIGS. 3 and 4.

The operation of the closed heating installation according to FIG. 1 is as follows.

During the filling of the installation with water, the apparatus 7 is disconnected from the feed 8, while the float-operated valve, because of the absence of water, is in the open position and functions as vent valve. Although in this situation, the blocking of the access to the non-return valve is removed, also because of the absence of water, the non-return valve will be in the closed position, because of the absence of an excess pressure in the system. During the rising of the water level, the float-operated valve will close first and, when the rise continues, the access to the non-return valve will be blocked. After the end of the filling phase, at which the pressure in the installation has been raised and the expansion tank has at least been partially filled with water, the connection with the feed 8 is established.

During operation, loss of water will at first be replenished by reducing in the usual manner the quantity of water in the expansion tank. Under those circumstances, the float-operated valve remains closed and the blocking of the access to the non-return valve is maintained. If the pressure should rise above the maximal working pressure, a safety valve comes into action for discharging water and hence limiting the maximal pressure in the installation.

Air extracted from the water collects in the air heads of the de-aerator 5 and the apparatus 7. The de-aerator 5 can, for instance, be provided with a float-operated valve for blowing off air to the environment when a given magnitude is exceeded by the air head. In the apparatus 7, during the fall of the water level due to the enlargement of the air head, the blocking will be removed and by the opening of the non-return valve, which is for instance set to the minimal working pressure, air will be blown off to the environment until the pressure at which the non-return valve shuts again is reached. Thus, an effective de-aeration is coupled to the guarantee that the minimal pressure remains present in the installation, so that the boiler is not switched off unintentionally by a boiling-dry protection.

If the expansion tank is exhausted, the water level in the apparatus 7 will fall, in particular during a falling temperature, so that after the removal of the blocking, the float-operated tank subsequently opens and water is supplied, so that water shortage is prevented. As a relatively low pressure prevails in the air head, due to the preceding de-aeration, the water supplied is degassed in a pressure stage process, i.e. air dissolved in the water or microbubbles present therein are released through the sudden pressure reduction and are possibly directly discharged via the non-return valve.

In this manner, there is provided an optimal de-aeration in combination with a maintenance of a minimal working pressure and a prevention of water shortage. The maintenance of a particular air head also means that it is provided that the water level always remains below the level of the valves in the apparatus 7, to that fouling of those valves is prevented.

Figure 2:
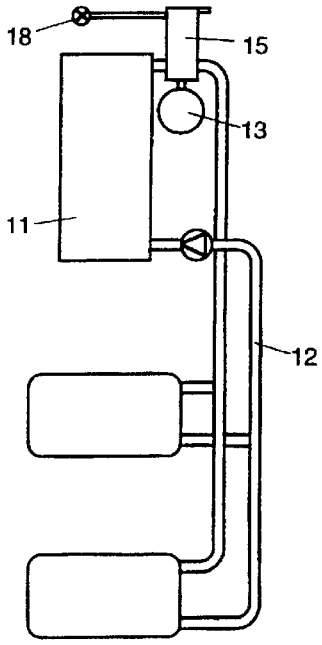
FIG. 2 shows a second embodiment of a closed heating installation.

FIG. 2 shows a closed heating installation with a boiler 11 and a pipe system 12, in which the boiler 11 is disposed adjacent the highest point of the installation, which has the advantage that the de-aerator 5 and apparatus 7 shown in FIG. 1 can be combined into one apparatus 15 which is coupled to a water supply 18 and is in open communication with an expansion tank 13. The operation of the installation of FIG. 2 is substantially identical to that of the installation of FIG. 1.

Figure 3:
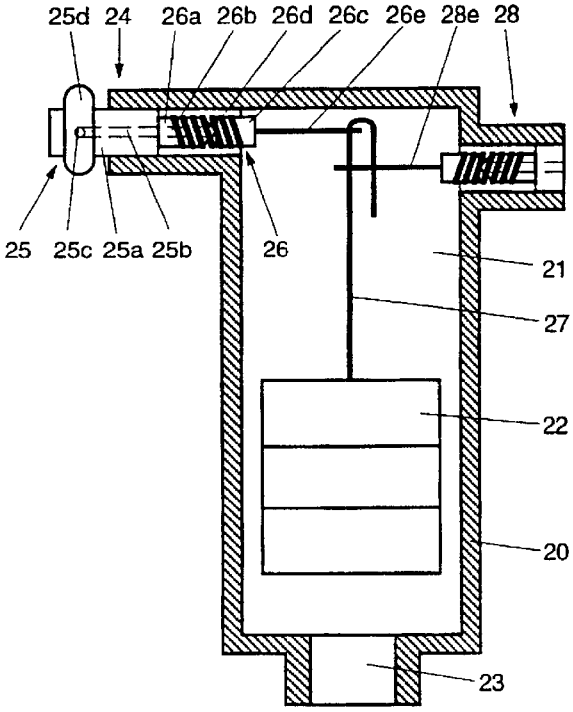
FIG. 3 shows a first embodiment of an apparatus to be used with the heating installation according to FIG. 1 or 2.

FIG. 3 shows a first embodiment of an apparatus 7 according to FIG. 1. The apparatus comprises a housing 20 with a chamber 21 containing a float 22. The chamber 21 comprises a bottom outlet 23 which is in open communication with the pipe system of the installation. At the top end of the chamber 21, in a housing opening, a vent valve 24 is mounted, comprising a non-return valve 25 and a blocking member 26.

The non-return valve 25 comprises a cylindrical housing 25*a* having a central channel 25*b* which does not extend to the free end of the housing 25*a* but continues in a radial channel 25*c* whose mouth is shut off by an O-ring 25*d*.

The blocking member 26 comprises a seating part 26*a* forming one whole with the housing 25*a* and having a central channel 26*b* which connects to the channel 25*b* and extends through the entire seating part 26*a*. Further, the blocking member 26 comprises a valve part 26*c* and a helical spring 26*d* which pulls the seating part 26*a* and the valve part 26*c*tightly together, so that the central channel 26*b* is shut off by the valve part 26*c*. The seating part 26*a* and the valve part 26*c* are of such design and coupled by the helical spring 26*d* such that the valve part 26*c* can swivel relative to the seating part 26*a* to release the central channel 26*b*. For that swivel movement, an arm 26*e* is present, having its free end provided with an eye for receiving a hook-shaped end of a float needle 27.

At a level slightly lower than the vent valve 24, a make-up valve 28 is mounted in the chamber 21 in a further housing opening, to which make-up valve a water supply connects, not shown. The make-up valve 28 has the same construction as the blocking member 26 and comprises an arm 28*e* whose free end is provided with an eye through which the float needle 27 extends.

As the make-up valve 28 is mounted at a lower level in the housing 20 than the vent valve 24, the arm 28*e* is at a lower level than the arm 26*e*. Hence, during the lowering of the float 22 in the housing 20, the float needle 27 will first cause the arm 26*e* to swivel downwards, so that the blocking member 26 opens and the access to the non-return valve 25 opens, and subsequently, when the float lowers further, the float needle will cause the arm 28*e* to swivel downwards to open the make-up valve 28. During rising of the float, the reverse takes place.

Figure 4:
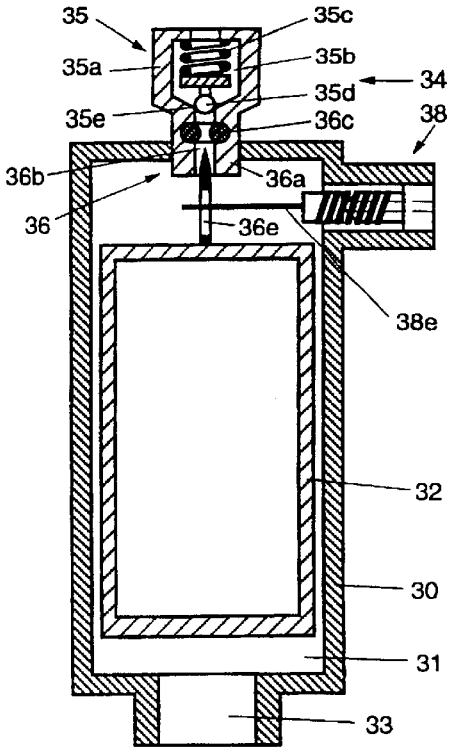
FIG. 4 shows a second embodiment of an apparatus to be used with a heating installation according to FIG. 1 or 2.

FIG. 4 shows a second embodiment of an apparatus 7 according to FIG. 1 or an apparatus 15 according to FIG. 2. The apparatus comprises a housing 30 with a chamber 31 containing a float 32. The chamber 31 comprises a bottom outlet 33 which is in open communication with the pipe system of the installation. In the top end of the chamber 31, in a housing opening, a vent valve 34 is mounted, comprising a non-return valve 35 and a blocking member 36.

The non-return valve 35 comprises a housing 35*a* having a chamber 35*b* containing a helical spring 35*c* which presses a valve part 35*d* against a seating part 35*e*.

The blocking member 36 comprises a housing 36*a* which forms a continuation of the housing 35*a* and comprises a central channel 36*b* provided with a groove accommodating O-ring 36*c* whose inner circumference extends into the channel 36*b*. The blocking member 36 further comprises a needle 36*e*, slidable in longitudinal direction into the channel 36*b* and connected to the float 32.

In a sidewall of the housing 30, in a housing opening, a make-up valve 38 is mounted which has the same construction as the make-up valve 28 in FIG. 3. Arm 38*e* of the make-up valve 38 extends through an eye in the needle 36*e*connected to the float 32. The positioning and dimensions of the eye are such that it causes the arm 38*e* to swivel only after the free end of the needle 36*e* is located at a distance below the O-ring 36*c*. In this manner, it is guaranteed also in this construction that during lowering of the float 32, the access to the non-return valve 35 is first released through the removal of the blocking by the blocking member 36, before the make-up valve 38 is opened through the further lowering of the float 32.

It is understood that within the framework of the invention as laid down in the appended claims, still many modifications and variants are possible. For instance, the blocking member according to FIG. 3 may also be combined with a non-return valve according to FIG. 4, or a blocking member according to FIG. 4 may be combined with a non-return valve according to FIG. 3. Further, the blocking members and non-return and make-up valves shown are merely possible, albeit advantageous structural variants, and can be replaced by elements having a similar function and operation. If so desired, there may also be present more than one vent valve per apparatus. Also, the hot-water installations according to FIGS. 1 and 2 may be constructed and supplemented in many other manners.

What is claimed is:

1. A method for operating a closed hot-water installation provided with a pipe system having a boiler and at least one heat exchanger and an expansion tank, a water make-up provision and a de-aerator disposed at a highest point of the installation and comprising a non-return valve mounted in a air head, said non-return valve opening at a predetermined pressure to allow air to escape from the closed installation, a water level in the de-aerator being detected for feeding water to the closed installation via the water make-up provision when the water level falls below a predetermined level by blocking opening of the non-return valve until it is detected that the water level has fallen to a first level and wherein feeding of water is started when a second level, lower than the first level is reached.

2. A method according to claim 1, wherein the detection of the first level and of the second level is carried out by a float.

3. A method according to claim 1, wherein the detection of the first and the second water levels is carried out by one single float, whereby, when the first level is being reached, a blocking of the de-aerator is removed and, when the second level is being reached, the water make-up provision is opened.

4. Apparatus for discharging air from and supplying water to a closed hot-water installation provided with a pipe system having a boiler and at least one heat exchanger, said apparatus comprising a housing having a bottom side which can be brought into open communication with the pipe system and a top side, and further comprising a vent valve disposed adjacent said top side and a water make-up valve operable by a float displaceable in said housing, said vent valve comprising a blocking member operable to shut off access to the vent valve in a blocking position, said blocking member moveable into an out of said blocking position by said float.

5. The apparatus according to claim 4 wherein the vent valve is a non-return valve which prevents connection to the environment during float controlled opening of de-aerating means and at a pressure in said housing lower than ambient pressure.

6. The apparatus according to claim 4, wherein said blocking member consists of a cylindrical seating part with a central bore, a cylindrical valve-part with a central bore and a spring which presses said seating and valve parts sealingly together yet allows swivel movement of said seating and valve parts relative to each other, one part being fixedly mounted in the housing and the other part having a float-operable lever arm.

7. The apparatus according to claim 4, wherein the blocking member consists of a needle and a sleeve capable of sealingly enclosing the needle, which needle, controlled by a float, can be slid in and pulled out of the sleeve.

8. The apparatus according to claim 7, wherein the sleeve accommodates an O-ring whose inner diameter is smaller than the needle diameter and the needle comprises a tip which can come to a stop in the O-ring.

9. The apparatus according to claim 4, wherein the non-return valve comprises a cylindrical housing having an axial channel which extends from one end of the housing and stops before the other end, where it is provided with at least one radial transverse channel which breaks through the housing and whose mouth is sealed by an O-ring which, during exertion of the opening pressure, recedes for releasing the month at least partially.

10. The apparatus according to claim 4, wherein the non-return valve comprises a seating part and a valve part pressed onto each other by a spring, which valve can be opened by compressing the spring.

11. The apparatus in accordance with claim 4 wherein the vent valve is a non-return valve operative to prevent connection to an outside environment when pressure inside said housing is lower than ambient pressure.

* * * * *

UNITED STATES PATENT AND TRADEMARK OFFICE

CERTIFICATE OF CORRECTION

PATENT NO. : 6,526,921 B1
DATED : March 19, 2001
INVENTOR(S) : Franciscus Roffelsen It is certified that error appears in the above-identified patent and that said Letters Patent is hereby corrected as shown below:

Column 6,
Line 8, please delete "month" and substitute therefore -- mouth --.

Signed and Sealed this

Sixth Day of May, 2003

JAMES E. ROGAN
*Director of the United States Patent and Trademark Office*